US005561261A

United States Patent [19]

Lindstädt et al.

[11] Patent Number: 5,561,261

[45] Date of Patent: Oct. 1, 1996

[54] TANDEM WARHEAD WITH A SECONDARY PROJECTILE

[75] Inventors: Klaus Lindstädt, Schwaig; Manfred Klare, Simmelsdorf, both of Germany

[73] Assignee: Diehl GmbH & Co., Nürnberg, Germany

[21] Appl. No.: 540,942

[22] Filed: Oct. 11, 1995

[30] Foreign Application Priority Data

Sep. 15, 1995 [DE] Germany ..... 195 34 217.8

[51] Int. Cl.[6] ..... F42B 12/16

[52] U.S. Cl. ..... 102/476; 102/308

[58] Field of Search ..... 102/306–310, 102/476, 489, 382, 389

[56] References Cited

U.S. PATENT DOCUMENTS

| | | | |
|---|---|---|---|
| 4,803,928 | 2/1989 | Kramer et al. | 102/476 |
| 5,107,766 | 4/1992 | Schliesske et al. . | |
| 5,309,843 | 5/1994 | Rentzsch et al. | 102/476 |

FOREIGN PATENT DOCUMENTS

| | | | |
|---|---|---|---|
| 0583642 | 2/1994 | European Pat. Off. . | |
| 1002092 | 3/1952 | France | 102/476 |
| 2552869 | 4/1985 | France | 102/476 |
| 3544528 | 4/1987 | Germany . | |
| 3229220 | 1/1992 | Germany . | |
| 4135392 | 4/1993 | Germany . | |
| 4436107 | 4/1996 | Germany . | |
| 4437042 | 4/1996 | Germany . | |

OTHER PUBLICATIONS

Falbe et al. (1992) "Römpp Chemie Lexikon", *Georg Thieme Verlag Stuttgart*, New York, pp. 3503–3504.

*Primary Examiner*—Harold J. Tudor

*Attorney, Agent, or Firm*—Scully, Scott, Murphy & Presser

[57] ABSTRACT

The present invention relates to a tandem warhead with a secondary projectile. An explosives gas protector shields the secondary projectile with respect to a hollow charge located in front of the secondary projectile, and wherein the housing possesses a conical section having a tubular segment of smaller diameter arranged thereon, whereby a bottom is provided on the tubular section which opposite the hollow charge has the secondary projectile smaller in caliber and at its circumference includes a screwthread into which there engages a screwthread of the tubular section, and whereby the secondary projectile contacts against the bottom under prestressing. The gas protector is located in a wedge-shaped annular space which is formed by the conical section of the housing and by means of the secondary projectile which projects from the tubular section into this annular space, and which seals the secondary projectile upon encountered gases of detonation with regard to the tubular section, and whereby the gas protector is constituted of a compressible material.

9 Claims, 1 Drawing Sheet

TANDEM WARHEAD WITH A SECONDARY PROJECTILE

BACKGROUND OF THE INVENTION

1. Field of the Invention

The present invention relates to a tandem warhead with a secondary projectile.

2. Discussion of the Prior Art

In a tandem warhead with a secondary projectile as disclosed in U.S. Pat. No. 4,803,928, a hollow charge is arranged at the head end thereof, and is retained in a tubular casing through the intermediary of screws which are adapted to be sheared through, whereby this tubular casing is screwed together with a firing or launch tube for a launchable secondary projectile. The secondary projectile is shearably pinned at the base end thereof to a casing for a propellant charge. A special protector against gases from explosives for the protection of the secondary charge is not provided therein. The reason for the foregoing can be ascertained in that the triggering of the hollow charge, or respectively, the bore charge, is initiated through the secondary projectile which is in motion. In addition thereto, the secondary projectile possesses an extremely heavy wall thickness in the region of its fuze.

A different construction is disclosed in a warhead pursuant to French Patent No. 1 002 092. In the projectile illustrated in FIG. 1 of the French patent, a hollow charge at the head end thereof is separated by means of a protector from explosives gases against a follow-up inertial projectile. The explosives gas protector is constructed as a generally large calibered disk and is seated on the projectile nose cone of the inertial projectile. In that manner, the nose cone of the inertial projectile is to be protected, while the hollow charge produces a through-passageway in the target. The material of the explosives gas protector is not disclosed.

SUMMARY OF THE INVENTION

Accordingly, it is an object of the present invention to propose an operationally reliable arrangement of a secondary projectile in a tandem warhead. Hereby, the secondary projectile is constructed as a fragmentation grenade with a fuze. Consequently, there is encountered the danger that gases generated from explosives will rupture the rear side of the secondary projectile, and this can lead to an irreversible damaging of the secondary projectile.

The invention has as an object to be able to solve the foregoing problem, in that an explosives gas protector shields the secondary projectile with respect to a hollow charge located in front of the secondary projectile, and wherein the housing possesses a conical section having a tubular segment of smaller diameter arranged thereon, whereby a bottom is provided on the tubular section which opposite the hollow charge has the secondary projectile smaller in caliber and at its circumference includes a screwthread into which there engages a screwthread of the tubular section, whereby the secondary projectile contacts against the bottom under prestressing, and wherein the gas protector is located in a wedge-shaped annular space which is formed by the conical section of the housing and by means of the secondary projectile which projects from the tubular section into this annular space, and which seals the secondary projectile upon encountered gases of detonation with regard to the tubular section, and whereby the gas protector is constituted of a compressible material.

Further advantageous embodiments of the invention may be readily ascertained from a detailed description thereof as set forth hereinbelow.

The secondary projectile is retained by means of a screwthreaded connection in a form-fitted and load-transmissive connection in a tubular segment of the tandem warhead which is constructed as a retaining tube. A gas protector secures the secondary projectile directly at the screwthreaded connection. Upon encountered detonation gases from the already triggered hollow charge, the gas protector is compressed into the rearwardly narrowing annular space, and thereby attains the actual sealing effect. During a second phase concurrently with a forward thrusting movement of the secondary projectile due to its inertia, there is effected the rupturing of the conical segment of the housing of the tandem projectile which is integrally connected with the tubular section. This leads to a rupturing of the screwthreaded connection, so that the secondary projectile due to its inertia enters its phase of free flight up to the striking into a crater of a through-passageway produced by the hollow charge.

The fastening components and the gas protector are simple and inexpensively manufacturable. The operational reliability or dependability of these parts is similarly present.

BRIEF DESCRIPTION OF THE DRAWINGS

Reference may now be had to the detailed description of an exemplary embodiment of the invention, taken in conjunction with the accompanying drawings; in which.

DETAILED DESCRIPTION OF A PREFERRED EMBODIMENT

Figure 1:
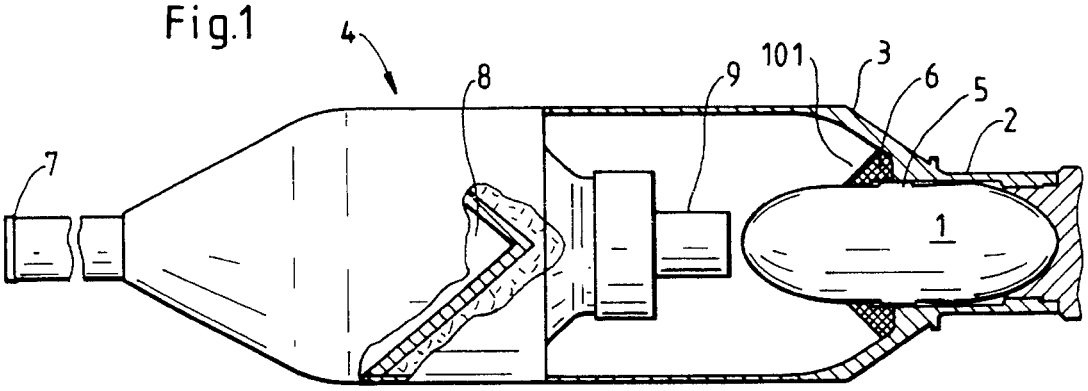
FIG. 1 illustrates a tandem warhead shown in a partially sectioned longitudinal view and which includes a secondary projectile.
Figure 2:
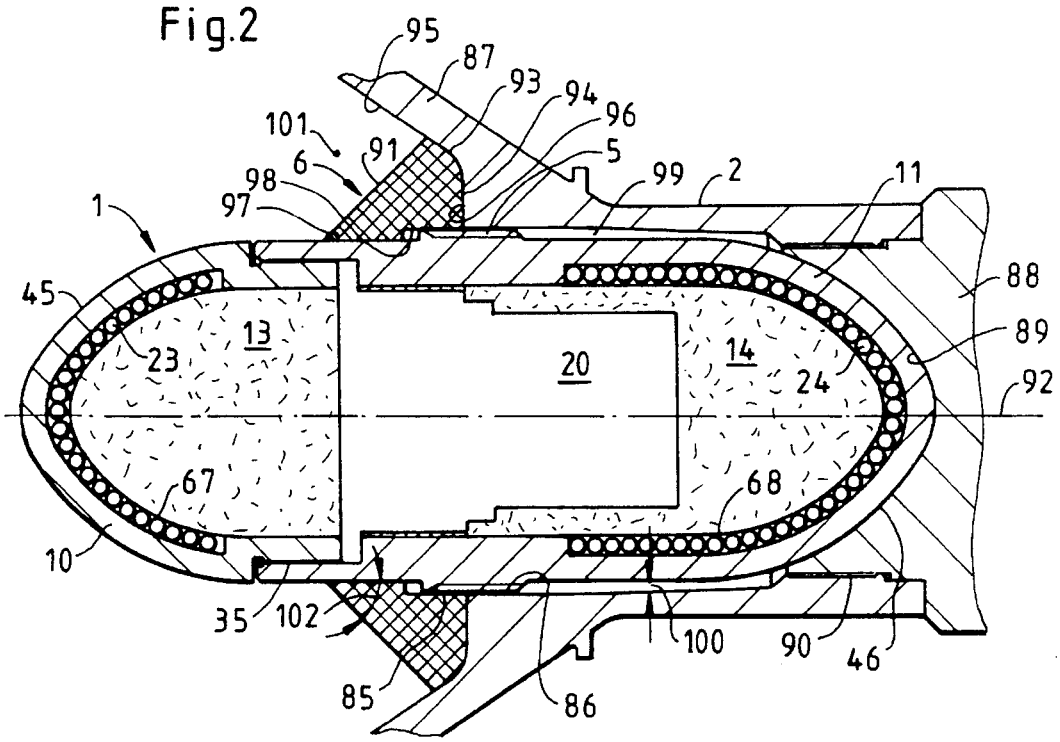
FIG. 2 illustrates a longitudinal sectional view through the secondary projectile of FIG. 1 as well as of the adjoining housing components.

Pursuant to FIG. 1, a secondary projectile 1 is supported in a tubular section 2 of a housing 3 of a tandem warhead 4, and connected through the intermediary of a screwthreaded connection 5 with the housing 3. A gas protector is designated by reference numeral 6.

The forward portion of the tandem warhead 4 possesses a proximity fuze 7 and a hollow charge 8 with a fuze 9.

The secondary projectile 1 consists of two housing portions 10, 11 which are interconnected in a screwthreaded manner by means of a screwthread 35. Nose cones 45, 46 are arranged on the housing portions 10, 11. Both nose cones 45, 46 each respectively possess a fragmentation charge 23, 24. The fragmentation charges 23, 24 are covered by casings 67, 68 with respect to active charges 13, 14 which are constituted of explosives. A fuze 20 separates the two active charges 13, 14 from each other.

The secondary projectile 1 which is smaller in caliber in comparison with the hollow charge 8, possesses a screwthread 85 along its circumference, and in correspondence therewith, the tubular section 2 possesses an internal screwthread 86.

The housing 3 possesses a conical section 87 with the cylindrical tubular section 2 arranged integrally thereon. By means of this tubular section 2, a bottom 88 with a recess 89 conformed with the nose cone 46 is screwed together by means of a screwthreaded connection 90. The nose cone 46 thus lies with an extremely large surface contact against the bottom 88. As a result thereof, the threaded connection 5 represents a so-called counter or safety securing device. During transport it ensures the secure fastening of the secondary projectile 1 in the tandem warhead 4.

The screwthreaded connection 5 between the tube section 2 and the secondary projectile is secured in the usual manner against loosening, for example, by means of a securing lacquer or varnish.

The gas protector 6 is conically constructed in a direction facing towards the hollow charge 8. Hereby, an end surface 91 lies at an acute angle 102 relative to the main axis 92 of the tandem warhead 4. The rearward surfaces 93, 94 lie against a conical surface 95 and against a bottom surface 96 located which extends at a right angle relative to the main axis 92. This angle 102 subtends between 30° and 50°, and preferably 45°, as illustrated.

The gas protector 6 is located in an annular wedge-shaped space 101 which reduces in size towards the bottom thereof, and which is formed by the conical section 87 of the housing 3 and by the secondary projectile 1.

The internal contour of the explosives or detonation gas protector 6 assembles itself from a sealing lip 97 contacting against the secondary projectile 1, and from a similarly annular or ring-shaped support surface 98.

The screwthread 86 of the screwthreaded connection 5 lies at the beginning of the tubular section 2. Connected thereto in the direction towards the bottom 88 is an open annular space 99. This annular space 99 is bounded in the rearward part thereof by the bottom 88. The gap 100 of the annular space 99 consists of 1 to 2 mm in size in the middle. The length of the annular space 99 consists of approximately one-third the length of the secondary projectile 1.

Upon the striking of the tandem warhead 4 against an enemy covering (not shown), by means of the hollow charge 8 there is formed a crater with a thereto connected through-passageway. Upon the detonation of the hollow charge 8, the rearward explosives or detonation gases exert an influence on the gas protector 6 as well as on the housing 3.

Under a timewise extended period of consideration, the gas protector 6 is compressed due to the high pressure of the explosives gases within the still existing housing 3, so that the explosives gases cannot pass through the screwthreaded connection to the bottom 88. Hereby, the sealing lip 97 is pressed along the circumference thereof in a corresponding direction against the secondary projectile 4. Also present is an elevated pressure of the gas protector 6 which is exerted compressively against the surfaces 95, 96 and at the screwthread 85. The gas protector 6 naturally does not retain the explosives gases for any lengthy period of time, but only during the decisive microsecond range. Within this range of time, the conical end surface 91 deflects the maximum pressure slightly outwardly, in effect, away from the screwthreaded connection 5.

During a second phase, the housing 3 ruptures in conjunction with the screwthreaded connection 5, whereby the secondary projectile 1 due to its inertia is already in a forward movement. Due to the rupturing housing 3, there is present a pressure reduction relative to the secondary projectile 1, so that there is no longer encountered any danger of the rupturing of the secondary projectile 1 due to the explosives gases.

The tubular section 2 remains stable due to the presence of the gas protector; in essence, it is not destroyed by the detonation gases. Thereby, during the forward movement of the secondary projectile 1, because of the annular space 99, there is effected a positional stabilization of the secondary projectile 1. As a result, this affords that the secondary projectile 1 is imparted a certain guidance and in order to be able to implement a stable phase of free flight and, namely, up to striking into the crater of the through-passageway.

The gas protector is constituted of an elastic material, in effect, a compressible plastic material. Suitable for this purpose are such as; for example, polyvinylchloride, polypropylene, polyamide, polyethylene, polyoxymethylene, acetal or polytetrafluoroethylene; which are normally abbreviated in the plastics technology as, respectively PVC and also PP, PA, PE, POM or PTFE.

What is claimed is:

1. A tandem warhead including a housing having a first tubular portion, a second tubular portion extending coaxially rearwardly of said first tubular portion and being of a smaller diameter than said first tubular portion, and a rearwardly reducing conical housing portion interconnecting said first and second tubular housing portions; a secondary projectile having a cylindrical portion being fixedly positioned in said second tubular portion and having a rear nose cone in contact with a bottom structure in said second tubular portion and a forward nose cone and a section of the cylindrical portion thereof extending forwardly into said first tubular portion; a hollow charge being arranged in said first tubular portion of said housing ahead of said secondary charge, said secondary charge being of a smaller caliber than the hollow charge; and a gas protector of an elastically compressible material sealing encompassing the cylindrical portion of said secondary projectile in a wedge-shaped annular space defined within the conical housing portion and said forwardly extending cylindrical portion of the secondary projectile so as to seal said second tubular housing portion from the effects of any detonation gases generated in said first housing portion.

2. A tandem warhead according to claim 1, wherein said gas protector has a wedge-shaped configuration in a direction facing towards said hollow charge so as to assist in the compression of said gas protector and enhancing the gas sealing effect thereof.

3. A tandem warhead according to claim 1, wherein said secondary projectile is in a screwthreaded connection with said second tubular portion of the housing.

4. A tandem warhead according to claim 1, wherein said conical housing portion includes a surface section in proximity about said cylindrical secondary projectile portion extending perpendicular to a longitudinal axis of said housing, said gas protector including surfaces sealingly contacting the conical surface and perpendicular surface of said conical housing portion and including an annular sealing lip encompassing at least a part of the forwardly extending cylindrical portion of said secondary projectile.

5. A tandem warhead according to claim 1, wherein the rear nose cone of said secondary projectile contacts said bottom structure in said second tubular portion in a form-fitting and large surface-contacting arrangement.

6. A tandem warhead according to claim 3, wherein said screwthreaded connection is located at an end of said second tubular portion proximate said gas protector contacting the secondary projectile.

7. A tandem warhead according to claim 6, wherein the screwthread of the screwthreaded connection on the second tubular portion is located at about the middle of the axial length of the secondary projectile, the rearwardly located end of the screwthreaded connection extending into a narrow annular space between the secondary projectile and the second tubular portion, said space having a length of about one-third the axial length of the secondary projectile and wherein said annular space is bounded by the bottom structure at a rearward end thereof.

8. A tandem warhead according to claim 1, wherein said first tubular portion, said second tubular portion and said conical housing portion of said housing are of an integral construction.

9. A tandem warhead according to claim 1, wherein the elastically compressible material of said gas protector comprises a plastic material selected from the group of materials consisting of polyvinylchloride, polypropylene, polyamide, polyethylene, polyoxymethylene, acetal and polytetrafluoroethylene.

* * * * *